US009766036B2

(12) United States Patent
Daley, Jr.

(10) Patent No.: US 9,766,036 B2
(45) Date of Patent: Sep. 19, 2017

(54) HAND GUARD FOR FIREARM

(71) Applicant: Sig Sauer, Inc., Newington, NH (US)

(72) Inventor: William C. Daley, Jr., Kingston, NH (US)

(73) Assignee: Sig Sauer, Inc., Newington, NH (US)

( * ) Notice: Subject to any disclaimer, the term of this patent is extended or adjusted under 35 U.S.C. 154(b) by 17 days.

(21) Appl. No.: 14/966,368

(22) Filed: Dec. 11, 2015

(65) Prior Publication Data

US 2016/0169617 A1 Jun. 16, 2016

Related U.S. Application Data

(60) Provisional application No. 62/091,906, filed on Dec. 15, 2014.

(51) Int. Cl.
*F41C 23/16* (2006.01)
*F41G 11/00* (2006.01)

(52) U.S. Cl.
CPC ..... *F41C 23/16* (2013.01); *F41G 11/004* (2013.01); *F41G 11/003* (2013.01)

(58) Field of Classification Search
CPC ..... F41C 23/16; F41G 11/004; F41G 11/003
USPC ..... 42/71.01, 73, 72, 96, 75.03; 89/191.01, 89/193
See application file for complete search history.

(56) References Cited

U.S. PATENT DOCUMENTS 7,363,741 B2 4/2008 DeSomma et al.
7,523,580 B1 * 4/2009 Tankersley ..... F41C 23/16 42/71.01
7,584,567 B1 9/2009 DeSomma et al.
7,770,317 B1 8/2010 Tankersley
7,775,150 B2 8/2010 Hochstrate et al.
7,793,452 B1 * 9/2010 Samson ..... F41C 23/16 42/71.01
7,938,055 B2 5/2011 Hochstrate et al.
8,037,633 B1 10/2011 Troy
8,046,949 B1 11/2011 Daniel
8,051,595 B2 11/2011 Hochstrate et al.
8,069,604 B2 12/2011 Larue
8,117,958 B2 2/2012 Hochstrate et al.
8,191,300 B2 * 6/2012 Daniel ..... F41C 23/16 42/71.01
8,201,353 B1 * 6/2012 Swan ..... F41C 23/16 42/71.01
8,234,809 B2 8/2012 Daniel
8,359,779 B2 * 1/2013 Daniel ..... F41C 23/16 42/71.01
8,453,364 B2 6/2013 Kucynko
8,505,433 B2 8/2013 Hochstrate et al.
8,528,246 B2 9/2013 Telles
8,607,490 B1 12/2013 Zinsner
8,640,372 B2 2/2014 Hochstrate et al.
(Continued)

*Primary Examiner* — John Cooper
(74) *Attorney, Agent, or Firm* — Finch & Maloney PLLC

(57) ABSTRACT

A hand guard-to-barrel clamping system having provisions for internal clamping fasteners is disclosed. A hand guard assembly includes upper and lower members each having bores tangential to a longitudinal axis of the assembly. The bores are arranged such that fasteners can be inserted through the bores for securing the upper and lower members together, thereby clamping the hand guard assembly to the firearm. Such fasteners are internal to the hand guard assembly, which provides a slim design that is easier to hold.

20 Claims, 5 Drawing Sheets

(56) References Cited

U.S. PATENT DOCUMENTS

| | | | | |
|---|---|---|---|---|
| 8,726,557 | B2 | 5/2014 | Stone et al. | |
| 8,726,558 | B1 * | 5/2014 | Nason | F41G 11/003 42/71.01 |
| 8,769,853 | B1 | 7/2014 | LaRue | |
| 8,783,160 | B2 | 7/2014 | Hochstrate et al. | |
| 8,806,793 | B2 | 8/2014 | Daniel et al. | |
| 8,819,980 | B2 | 9/2014 | Geissele | |
| 9,476,672 | B2 * | 10/2016 | Wells | F41C 23/16 |
| 2005/0000142 | A1 * | 1/2005 | Kim | F41G 11/003 42/124 |
| 2010/0162608 | A1 * | 7/2010 | McCann | F41C 23/16 42/71.01 |
| 2010/0175293 | A1 * | 7/2010 | Hines | F41C 23/16 42/71.01 |
| 2011/0192066 | A1 * | 8/2011 | Kimmel | F41C 23/16 42/71.01 |
| 2011/0239513 | A1 * | 10/2011 | Sandman | F41C 23/16 42/90 |
| 2012/0042557 | A1 * | 2/2012 | Gomez | F41C 23/16 42/90 |
| 2012/0124880 | A1 * | 5/2012 | Leclair | F41A 21/484 42/71.01 |
| 2012/0198990 | A1 | 8/2012 | Brittin | |
| 2012/0311910 | A1 * | 12/2012 | Mironichev | F41C 23/10 42/90 |
| 2013/0219765 | A1 | 8/2013 | Ibarguren | |
| 2014/0068987 | A1 | 3/2014 | Burt | |
| 2014/0076146 | A1 * | 3/2014 | Gomez | F41A 21/487 89/191.01 |
| 2014/0305019 | A1 * | 10/2014 | King, Jr. | F41C 23/18 42/71.01 |
| 2016/0169617 | A1 * | 6/2016 | Daley, Jr. | F41C 23/16 42/71.01 |

* cited by examiner

HAND GUARD FOR FIREARM

CROSS REFERENCE TO RELATED APPLICATIONS

This application claims the benefit of U.S. Provisional Patent Application Ser. No. 62/091,906, filed Dec. 15, 2014, which is hereby incorporated by reference in its entirety.

FIELD OF THE DISCLOSURE

This disclosure relates generally to firearms, and more particularly, to a hand guard-to-barrel clamping system having provisions for internal clamping fasteners.

BACKGROUND

A hand guard is a device attached to a firearm for gripping the weapon and for protecting the hands of the user from the barrel, which may become very hot when firing. One existing two-piece hand guard design that surrounds a portion of the barrel of a firearm includes flanges that protrude outwardly from the firearm. Fasteners pass through the flanges for mechanically securing the top and bottom portions of the hand guard together. Another existing design uses radial screws to secure the hand guard in the vicinity of the barrel nut.

SUMMARY

A hand guard-to-barrel clamping system having provisions for internal clamping fasteners is disclosed. According to an example embodiment, a hand guard assembly includes upper and lower members each having bores tangential to a longitudinal axis of the assembly. The bores are arranged such that fasteners can be inserted through the bores for securing the upper and lower members together, thereby clamping the hand guard assembly to the firearm. Such fasteners are internal to the hand guard assembly, which provides a slim design that is easier to hold. This example embodiment is in contrast to existing clamping systems that use flanges, which tend to protrude from the hand guard, or existing clamping systems that use radial screws, which are easily visible.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The protruding flanges of some existing hand guard designs add bulk to the weapon and increase the width of the hand guard, making the firearm uncomfortable to hold. The heads of radial screws used in some existing designs face outwardly from the hand guard. Such flanges and visible screws are cosmetically unappealing.

Thus, and in accordance with a set of embodiments, a hand guard-to-barrel clamping system having provisions for internal clamping fasteners is disclosed. In an embodiment, a hand guard assembly attachable to a receiver of a barrel of a firearm includes a C-shaped lower hand guard member and an upper hand guard member. The C-shaped lower hand guard member has an internal surface defining a central hollow concentric about a longitudinal axis of the lower hand guard member, an external surface, a first lower hand guard mating surface extending between a first end of the internal surface and a first end of the external surface, where the first lower hand guard mating surface lies in a first plane, a second lower hand guard mating surface extending between a second end of the internal surface and a second end of the external surface, where the second lower hand guard mating surface lies in a different second plane that intersects the first plane, and a first plurality of bores tangential to the longitudinal axis, each of which extends through one of the first and second lower hand guard mating surfaces. The upper hand guard member has a first upper hand guard mating surface configured to abut the first lower hand guard mating surface in facing relationship when the upper hand guard member is mated or attached to the lower hand guard member, a second upper hand guard mating surface configured to abut the second lower hand guard mating surface in facing relationship when the upper hand guard member is mated or attached to the lower hand guard member, and a second plurality of bores tangential to the longitudinal axis, each of which extends between one of the first and second upper hand guard mating surfaces and another surface distal from respective first or second upper hand guard mating surface. Each of the first and second plurality of bores is internal to the hand guard assembly when the upper hand guard member is mated or attached to the lower hand guard member. Numerous configurations and variations will be apparent in light of this disclosure. Other suitable uses and implementations of one or more embodiments of the present disclosure will depend on a given application and will be apparent in light of this disclosure.

Figure 1:
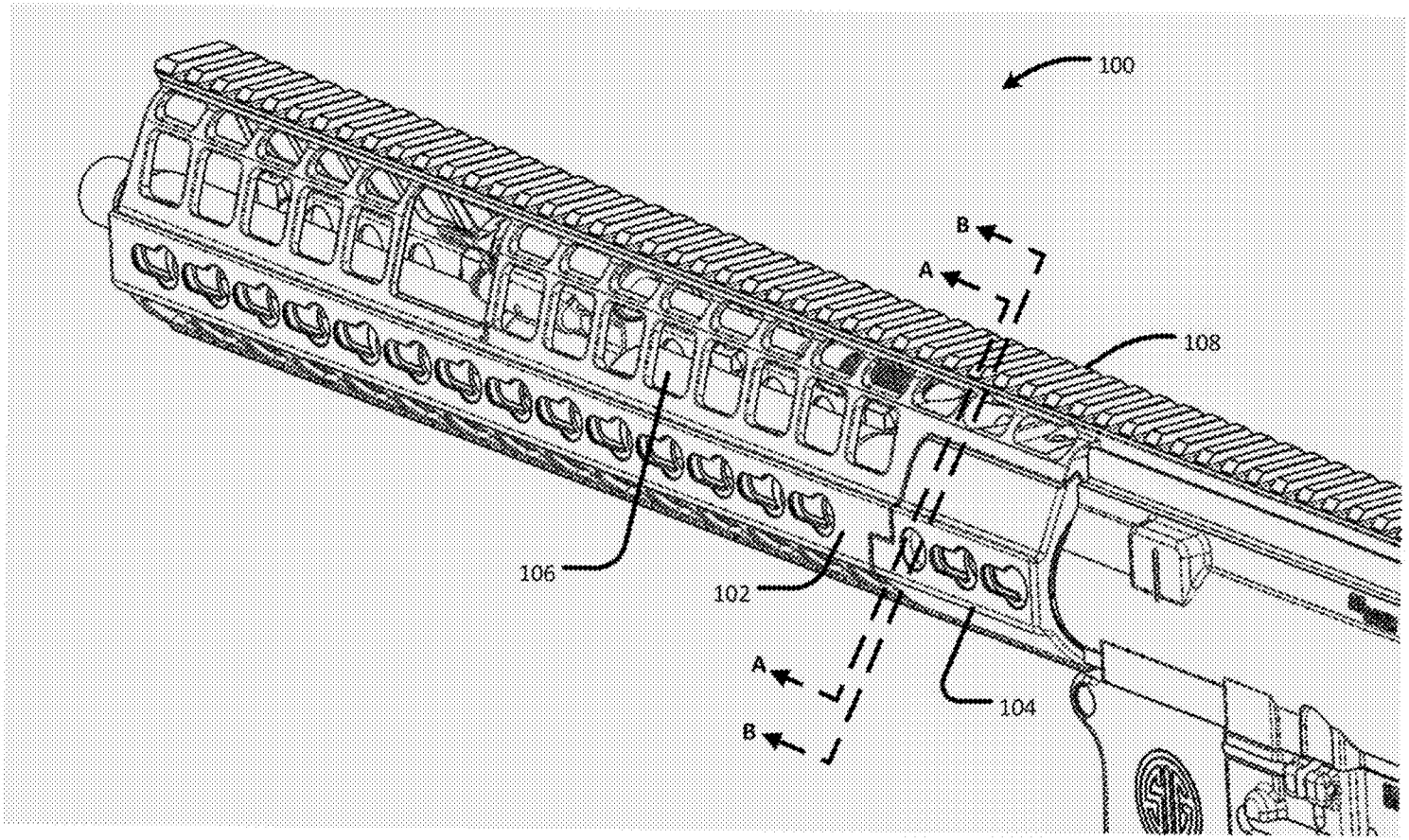
FIG. 1 is a partial left side perspective view of an example hand guard assembly for a firearm, in accordance with an embodiment of the present disclosure.
Figure 2:
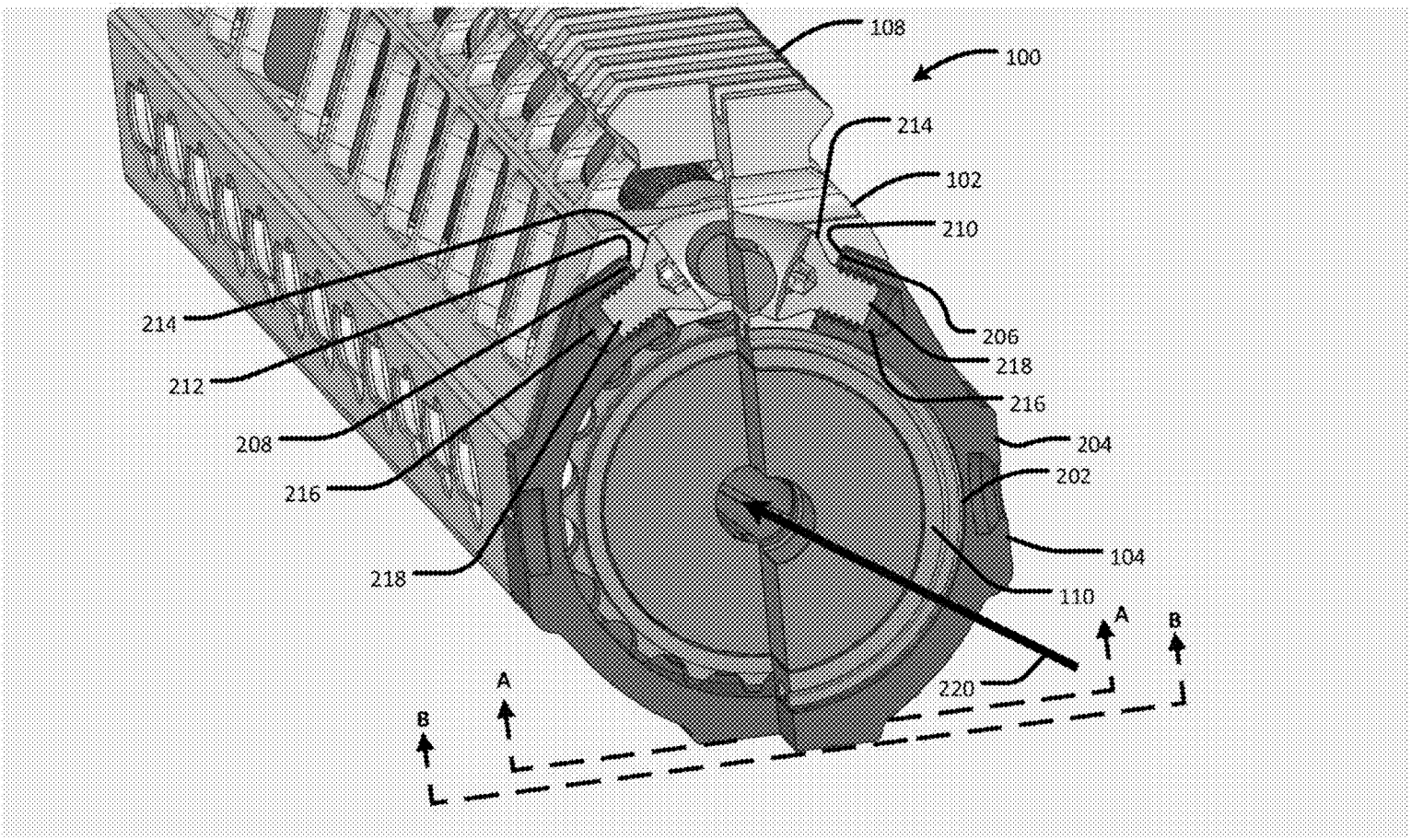
FIG. 2 is a partial left side cutaway perspective view of the example hand guard assembly of FIG. 1, taken along two cut lines A-A and B-B, in accordance with an embodiment of the present disclosure.

FIG. 1 is a partial left side perspective view of an example hand guard assembly 100 for a firearm, in accordance with an embodiment. For illustrative purposes not all components of the firearm are shown. The hand guard assembly 100 includes an upper member 102 and a C-shaped lower member 104 that, when coupled, mated or attached together, surround a barrel 106 of the firearm and form a clamp, which secures the hand guard assembly 100 to the firearm. In some embodiments, the upper member 102 of the hand guard includes a rail 108, which may be integral to the upper member but does not form any part of the clamp. In some embodiments, the firearm may include a barrel nut 110, a portion of which is shown in FIG. 2. The hand guard assembly 100 may engage the barrel nut 110, which prevents the assembly 100 from sliding away from the receiver. Other components of a firearm in which embodiments variously described herein may be implemented that are not illustrated, such as a body, stock and trigger, will be apparent. The structure and further details of the hand guard assembly 100 will be described with respect to the following drawings.

FIG. 2 is a partial left side cutaway perspective view of the example hand guard assembly 100 of FIG. 1, taken along two cut lines A-A and B-B. The C-shaped lower member 104 has an internal surface 202, an external surface 204, and a pair of mating surfaces 206 and 208. Each of the mating surfaces 206 and 208 of the lower member 104 extend between one end of the internal surface 202 and one end of the external surface 204 (e.g., adjacent to or near the opening of the C-shaped member). The internal surface 202 of the lower member 104 defines a central hollow concentric about a longitudinal axis 220 of the lower member, which allows the hand guard assembly 100 to encompass the barrel nut 110. The longitudinal axis 220 is coincident with the centerline of the barrel bore of the firearm. The upper member 102 has a pair of mating surfaces 210 and 212 that are configured to abut the lower member mating surfaces 206 and 208, respectively, when the upper member 102 is coupled, mated or attached to the lower member 104.

Figure 3:
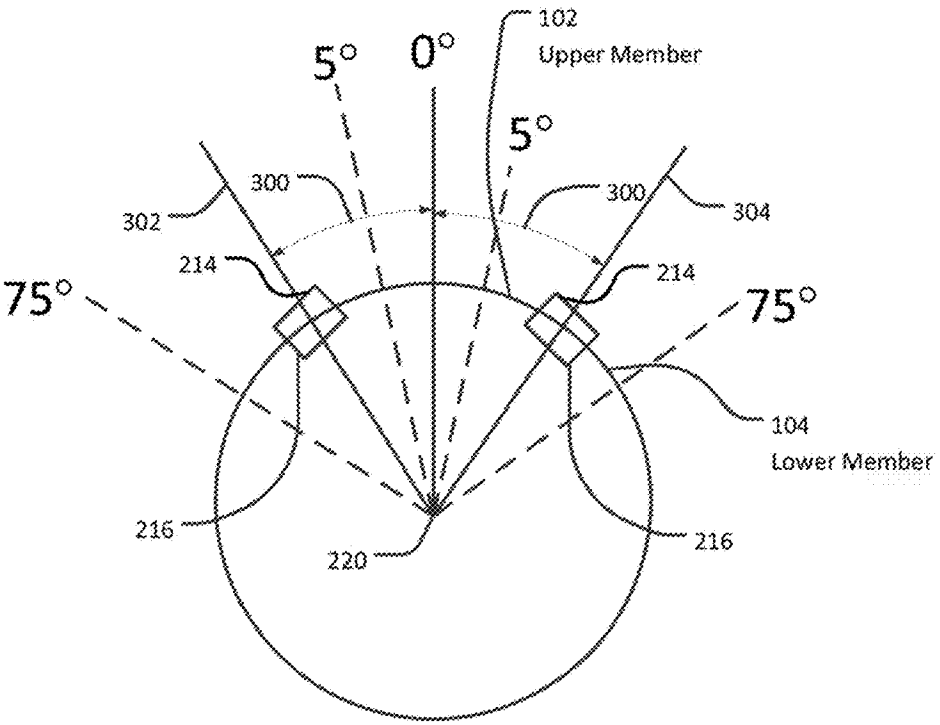
FIG. 3 is a schematic cross-sectional end view of the example hand guard assembly of FIG. 1, in accordance with an embodiment of the present disclosure.

A plurality of bores 214 are formed in the upper member 102 of the hand guard assembly 100. Each of the bores 214 extends between one of the first and second upper hand guard mating surfaces 210, 212 and another surface distal from respective first or second upper hand guard mating surface (e.g., the bore extends all the way through the member). The bores 214 may be tapered to conform to the shape of a screw head or other fastener. A plurality of corresponding cylindrically shaped bores 216 are formed in the lower member 104 of the hand guard assembly 100. Each bore 214 in the upper member 102 is aligned with a corresponding bore 216 in the lower member 104 when the upper member 102 is coupled, mated or attached to the lower member 104. The bores 214 and 216 are substantially tangential to the longitudinal axis 220. In some cases, the bores 214 and 216 are located substantially above the longitudinal axis 220. For example, as illustrated in FIG. 3, the bores 214 and 216 may be oriented tangentially at an angle 300 of between about 5 and 75 degrees from directly above the longitudinal axis 220, where the upper member 102 is located above the axis 220. The bores 214, 216 are substantially orthogonal to the planes of the mating surfaces 206 and 208 of the lower member 104, and the planes of the facing mating surfaces 210 and 212 of the upper member 102. These planes are indicated by lines 302 and 304 and intersect at or near the longitudinal axis 220.

Referring again to FIG. 2, in some embodiments, the interior of each bore 216 in the lower member 102 is threaded to accept a threaded fastener 218 (e.g., a helical thread pattern for a screw), although it will be understood that non-threaded fasteners (e.g., an anchor-style fastener, such as a wedge anchor or other similar mechanism) may be utilized with an non-threaded bore 216. The fasteners 218 operate to secure the upper member 102 to the lower member 104. When the upper member 102 is mated or attached to the lower member 104, the bores 214 and 216 are internal to the hand guard assembly 100. As used in this disclosure, the term "internal to the hand guard assembly" refers to a location that is not coincident with or immediately adjacent to an overall external surface or perimeter of the hand guard assembly, including the upper and lower members 102, 104 together. In other words, the bores 214 or 216 are not adjacent to the outermost surfaces of the hand guard assembly 100, but are rather recessed internally.

With respect to such embodiments as variously described in this disclosure, it is particularly noted that both the bores 214, 216 and fasteners 218 are internal to the hand guard assembly 100, and therefore the clamping mechanism of the assembly does not protrude or extend beyond the exterior perimeter of the body of the assembly.

Figure 4:
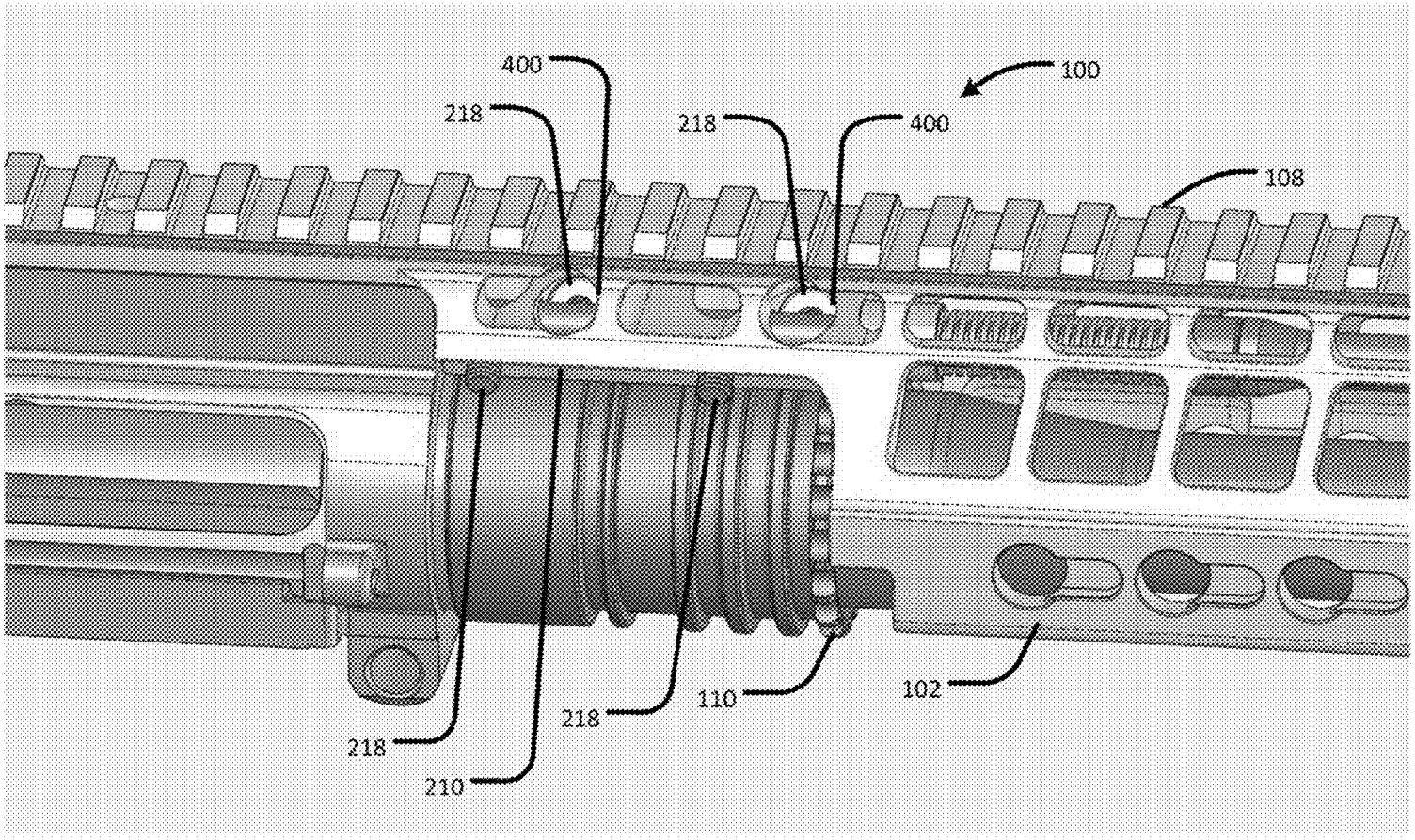
FIG. 4 is a partial right side perspective view of the example hand guard assembly of FIG. 1 with the lower member removed, in accordance with an embodiment of the present disclosure.
Figure 5:
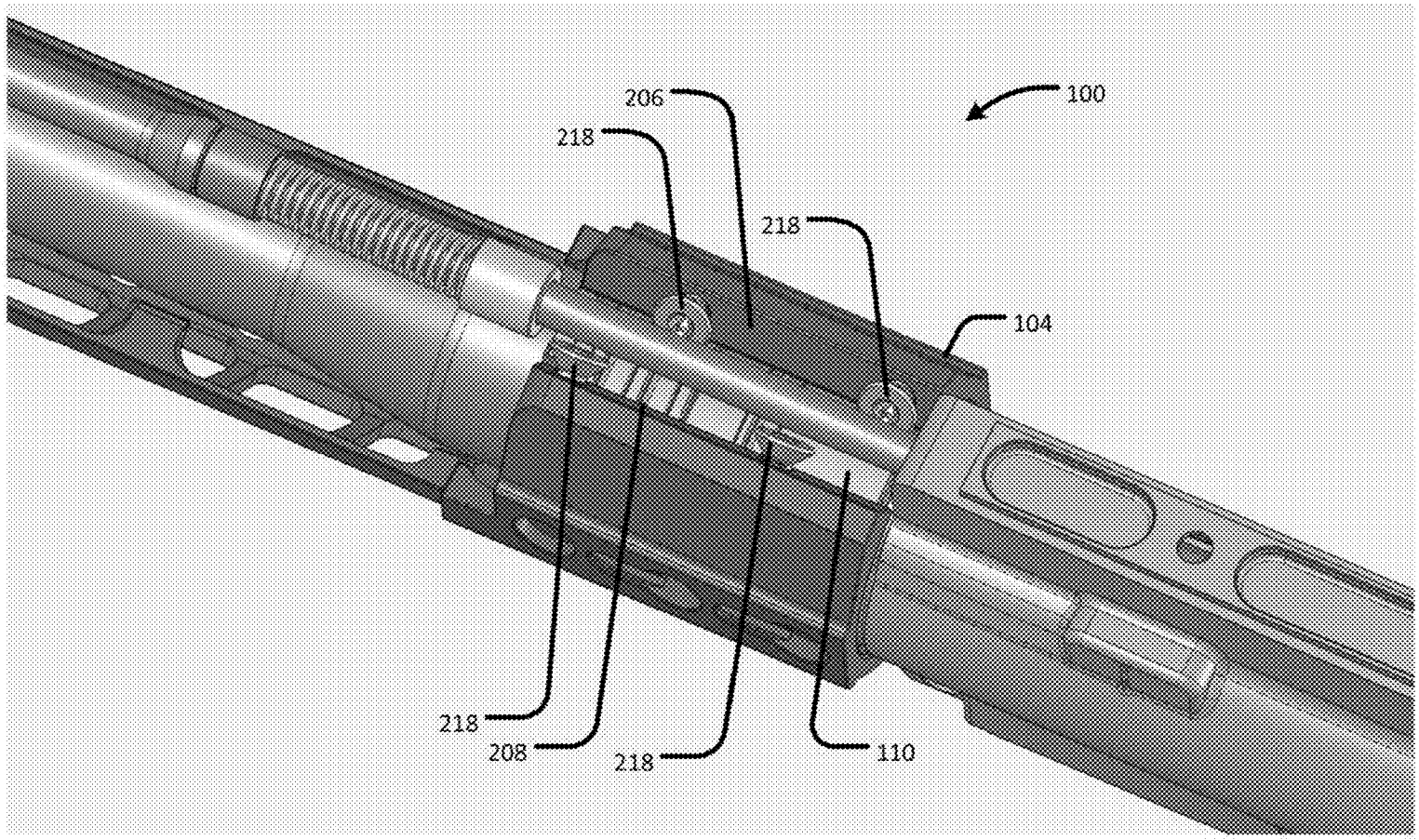
FIG. 5 is a partial upper left side perspective view of the example hand guard assembly of FIG. 1 with the upper member removed, in accordance with an embodiment of the present disclosure.

FIG. 4 is a partial right side perspective view of the example hand guard assembly 100 of FIG. 1 with the lower member removed, in accordance with an embodiment. FIG. 5 is a partial upper left side perspective view of the example hand guard assembly 100 of FIG. 1 with the upper member removed, in accordance with an embodiment. In an embodiment, as shown in FIGS. 4 and 5, the fasteners 218, and thus the corresponding bores 214 and 216 (not shown) in which the fasteners 218 are located, can be arranged in a staggered pattern along the longitudinal axis 220 across the respective mating surfaces 206/210, 208/212 of the upper and lower members 102, 104. Such a pattern may include, for example, where the fasteners 218 through one side of the upper and lower members 102, 104 are shifted toward the butt portion of the firearm (e.g., rearward), and the fasteners 218 through the other side of the upper and lower members 102, 104 are shifted away from the butt portion (e.g., forward). It will be understood that in some embodiments, the bores 214, 216 need not be arranged in the staggered pattern shown in FIGS. 2, 4 and 5 (e.g., they may be directly opposite each other), or the bores may be located in another suitable arrangement (e.g., odd number on one side, even number on the other side, etc.).

In an embodiment, as shown in FIG. 4, the upper member 102 includes access holes 400 on both sides of the upper member 102 (only one side is shown, the other side is similar) for inserting the fasteners 218 into the hand guard assembly 100 and further for inserting any tool used to operate the fasteners 218, such as a screwdriver. The access holes 400 are axially aligned with the bores 214, 216.

As will be appreciated in light of this disclosure, the hand guard assembly 100 may include additional, fewer, and/or different elements or components from those here described, and the present disclosure is not intended to be limited to any particular configurations or arrangements of elements such as those variously described herein, but can be used with numerous configurations in numerous applications. Further, while in some embodiments, the hand guard assembly 100 can be configured as shown and described with respect to the various figures, the claimed invention is not so limited. Other suitable geometries, arrangements and configurations for various elements and components of the apparatus will depend on a given application and will be apparent in light of this disclosure.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Subsequent applications claiming priority to this application may claim the disclosed subject matter in a different manner and generally may include any set of one or more limitations as variously disclosed or otherwise demonstrated herein.

What is claimed is:

1. A hand guard assembly attachable to a receiver of a barrel of a firearm, comprising:

a lower hand guard member having a first plurality of bores formed therein, each of the first plurality of bores being tangential to an internal surface of the lower hand guard member, the internal surface defining a central hollow concentric about a longitudinal axis of the lower hand guard member; and an upper hand guard member having a second plurality of bores formed therein, each of the second plurality of bores being tangential to the internal surface and being axially aligned with a respective one of the first plurality of bores while the upper hand guard member is mated or attached to the lower hand guard member;

wherein each of the first and second plurality of bores is entirely beneath an overall external surface the hand guard assembly while the upper hand guard member is mated or attached to the lower hand guard member.

2. The hand guard assembly of claim 1, wherein at least one of the first and second plurality of bores is internally threaded.

3. The hand guard assembly of claim 1, wherein each of the first and second plurality of bores are configured to receive a fastener therethrough, firstly through the second plurality of bores and secondly through the first plurality of bores, the fastener being recessed beneath the overall external surface of the hard guard assembly while fastener is used to attach the upper hand guard member to the lower hand guard member.

4. The hand guard assembly of claim 3, further comprising the fastener.

5. The hand guard assembly of claim 3, wherein the fastener is a screw.

6. The hand guard assembly of claim 1, wherein the first and second plurality of bores are located substantially above a bore centerline of the firearm.

7. The hand guard assembly of claim 1, wherein each pair of corresponding ones of the first and second plurality of bores are arranged in a staggered pattern along the longitudinal axis.

8. The hand guard assembly of claim 1, wherein the upper member includes a plurality of access holes each axially aligned with a respective one of the second plurality of bores for inserting fasteners into the second plurality of bores.

9. A hand guard assembly attachable to a receiver of a barrel of a firearm, comprising:

a C-shaped lower hand guard member comprising:

an internal surface defining a central hollow concentric about a longitudinal axis of the lower hand guard member;

an external surface;

a first lower hand guard mating surface extending between a first end of the internal surface and a first end of the external surface, the first lower hand guard mating surface lying in a first plane;

a second lower hand guard mating surface extending between a second end of the internal surface and a second end of the external surface, the second lower hand guard mating surface lying in a different second plane that intersects the first plane; and a first plurality of bores tangential to the internal surface of the lower hand guard member, each of which extends through one of the first and second lower hand guard mating surfaces; and an upper hand guard member comprising:

a first upper hand guard mating surface configured to abut the first lower hand guard mating surface in facing relationship while the upper hand guard member is mated or attached to the lower hand guard member;

a second upper hand guard mating surface configured to abut the second lower hand guard mating surface in facing relationship while the upper hand guard member is mated or attached to the lower hand guard member; and a second plurality of bores tangential to the the internal surface of the lower hand guard member while the upper hand guard member is attached to the lower hand guard member, each of which extends between one of the first and second upper hand guard mating surfaces and another surface distal from respective first or second upper hand guard mating surface and is axially aligned with a respective one of the first plurality of bores while the upper hand guard member is mated or attached to the lower hand guard member;

wherein each of the first and second plurality of bores is entirely beneath an overall external surface of the hand guard assembly while the upper hand guard member is mated or attached to the lower hand guard member.

10. The hand guard assembly of claim 9, wherein at least one of the first and second plurality of bores is internally threaded.

11. The hand guard assembly of claim 9, wherein each of the first and second plurality of bores are configured to receive a fastener therethrough, firstly through the second plurality of bores and secondly through the first plurality of bores, the fastener being recessed beneath the overall external surface of the hard guard assembly while fastener is used to attach the upper hand guard member to the lower hand guard member.

12. The hand guard assembly of claim 11, further comprising the fastener.

13. The hand guard assembly of claim 11, wherein the fastener is a screw.

14. The hand guard assembly of claim 9, wherein the first and second plurality of bores are located substantially above a bore centerline of the firearm.

15. The hand guard assembly of claim 9, wherein each pair of corresponding ones of the first and second plurality of bores are arranged in a staggered pattern along the longitudinal axis across the respective first and second upper and lower hand guard mating surfaces.

16. The hand guard assembly of claim 9, wherein the upper member includes a plurality of access holes each axially aligned with a respective one of the second plurality of bores for inserting fasteners into the second plurality of bores.

17. A kit comprising:

a lower hand guard member having a first plurality of bores formed therein, each of the first plurality of bores being tangential to an internal surface of the lower hand guard member, the internal surface defining a central hollow concentric about a longitudinal axis of the lower hand guard member;

an upper hand guard member having a second plurality of bores formed therein, each of the second plurality of bores being tangential to the internal surface and being axially aligned with a respective one of the first plurality of bores while the upper hand guard member is mated or attached to the lower hand guard member; and a plurality of fasteners configured to be received within the first and second plurality of bores for securing the upper hand guard member to the lower hand guard member,. the fastener configured to be recessed beneath an overall external surface of the hard guard assembly while fastener is used to attach the upper hand guard member to the lower hand guard member;

wherein each of the first and second plurality of bores is entirely beneath the overall external surface of the hand guard assembly while the upper hand guard member is mated or attached to the lower hand guard member.

18. The kit of claim 17, wherein the first and second plurality of bores are located substantially above a bore centerline of the firearm.

19. The kit of claim 17, wherein the upper member includes a plurality of access holes each axially aligned with a respective one of the second plurality of bores for inserting the fasteners into the second plurality of bores.

20. The kit of claim 17, further comprising a tool for operating the fasteners.

* * * * *